US012485332B2

(12) United States Patent
Pizzullo

(10) Patent No.: US 12,485,332 B2
(45) Date of Patent: Dec. 2, 2025

(54) PROJECTILE RAMP-LAUNCHING GAME AND METHOD OF PLAY

(71) Applicant: Pizzy Products, LLC, Wildwood, MO (US)

(72) Inventor: Andrew J. Pizzullo, Brentwood, MO (US)

(73) Assignee: Pizzy Product, LLC, Grover, MO (US)

( * ) Notice: Subject to any disclaimer, the term of this patent is extended or adjusted under 35 U.S.C. 154(b) by 714 days.

(21) Appl. No.: 17/873,264

(22) Filed: Jul. 26, 2022

(65) Prior Publication Data

US 2022/0355172 A1 Nov. 10, 2022

Related U.S. Application Data

(63) Continuation of application No. PCT/US2021/060727, filed on Nov. 24, 2021.

(60) Provisional application No. 63/117,620, filed on Nov. 24, 2020.

(51) Int. Cl.

| | |
|---|---|
| ***A63B 67/06*** | (2006.01) |
| *A63F 7/00* | (2006.01) |
| *A63F 7/24* | (2006.01) |

(52) U.S. Cl.

CPC ..... *A63B 67/06* (2013.01); *A63B 2210/50* (2013.01); *A63F 7/0017* (2013.01); *A63F 2007/007* (2013.01); *A63F 7/249* (2013.01)

(58) Field of Classification Search

CPC . A63B 67/06; A63B 2210/50; A63B 2210/10; A63F 7/0017; A63F 7/249; A63F 2007/007; A63F 2007/0011; A63F 2009/0053; A63F 2250/024; A63F 7/0005

USPC ..... 273/352

See application file for complete search history.

(56) References Cited

U.S. PATENT DOCUMENTS

| | | | | |
|---|---|---|---|---|
| 961,595 | A * | 6/1910 | Fitch | A63F 7/025 473/109 |
| 1,390,270 | A | 9/1921 | Blackburn | |
| 1,756,299 | A | 4/1930 | Owens | |
| 1,783,338 | A | 12/1930 | Mann | |
| 2,145,840 | A | 1/1939 | Thompson et al. | |
| 2,326,859 | A | 8/1943 | Hoover | |
| 2,327,702 | A | 8/1943 | Flynt | |
| 2,432,824 | A | 12/1947 | Shetler | |
| 2,472,719 | A | 6/1949 | Mysels | |

(Continued)

OTHER PUBLICATIONS

International Search Report and Written Opinion of the International Searching Authority in International application No. PCT/US2021/60727, filed Nov. 24, 2021.

*Primary Examiner* — Michael C Grant
(74) *Attorney, Agent, or Firm* — Grace J. Fishel

(57) ABSTRACT

A first game apparatus for inside or outdoor use comprising an elongated runway having a front end and a rear end with a ramp positioned at the front end, a target supported above the runway at the back of the ramp, said ramp having a curvature such that a projectile propelled along the runway from the rear end, passing under the target, and sliding up the ramp is given an upward trajectory curving towards a target of a second game apparatus. In one embodiment, the target is mounted on a U-shaped frame with ends forming a dogleg out of the plane of the frame for positioning the target at an incline or vertically. In most embodiments the target includes at least one aperture for receipt of a projectile such as bean bag.

15 Claims, 9 Drawing Sheets

(56) References Cited

U.S. PATENT DOCUMENTS

| | | | | |
|---|---|---|---|---|
| 2,704,212 | A | 3/1955 | Dunseith | |
| 2,793,861 | A | 5/1957 | Konopka | |
| 3,092,387 | A | 6/1963 | Wagner | |
| 3,106,399 | A | 10/1963 | Bibanoff et al. | |
| 3,912,271 | A | 10/1975 | Stevenson | |
| 4,019,739 | A | 4/1977 | Waite | |
| 4,323,250 | A | 4/1982 | Lansberry | |
| 4,343,470 | A | 8/1982 | Grifhorst | |
| 5,031,919 | A | 7/1991 | Dixon | |
| 2002/0092445 | A1* | 7/2002 | Glover ..... | A47B 3/087 108/36 |
| 2008/0116644 | A1 | 5/2008 | Knoernschild | |
| 2017/0128805 | A1 | 5/2017 | Cohen et al. | |
| 2018/0085649 | A1 | 3/2018 | O'Neill | |
| 2020/0047060 | A1 | 2/2020 | Bauer | |

* cited by examiner

PROJECTILE RAMP-LAUNCHING GAME AND METHOD OF PLAY

BACKGROUND OF THE INVENTION

Field of the Invention

The present invention relates to a game apparatus played from one end wherein a projectile such as a bean bag, ball, puck or the like is launched off the apparatus, not thrown, towards a target on a second similar game apparatus.

Brief Description of the Prior Art

The present game apparatus is primarily intended for recreational use in the category of yard games but as described below may be scaled for table top use also. Relevant prior art games include skee ball and beer pong. Skee ball is a single player game wherein a ball is rolled at a target facing the player. While of a size appropriate for outdoor use, the equipment is much too large and heavy to be used as a yard game. Beer pong is a table top game with the players facing each other and a target of cups at opposite ends of a table into which balls thrown. There are many yard games wherein a ball, dart, horseshoe or the like is thrown at a target. What is lacking is a portable game apparatus for outside use wherein projectiles are launched down a ramp, not thrown.

BRIEF SUMMARY OF THE INVENTION

In view of the above, it is an object of the present invention to provide a game apparatus in which projectiles are launched, not thrown.

The subject game apparatus has an elongated runway having a front end and rear end with a ramp positioned at the front end with a target supported above the runway before the ramp. The ramp has a curvature such that a projectile propelled along the runway, passing under the target, and striking the ramp is given a trajectory curving towards a second similar game apparatus with a target, said target having at least one receiver configured to catch the projectile.

BRIEF DESCRIPTION OF THE SEVERAL VIEWS OF THE DRAWINGS

In the accompanying drawings, in which one of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 11:
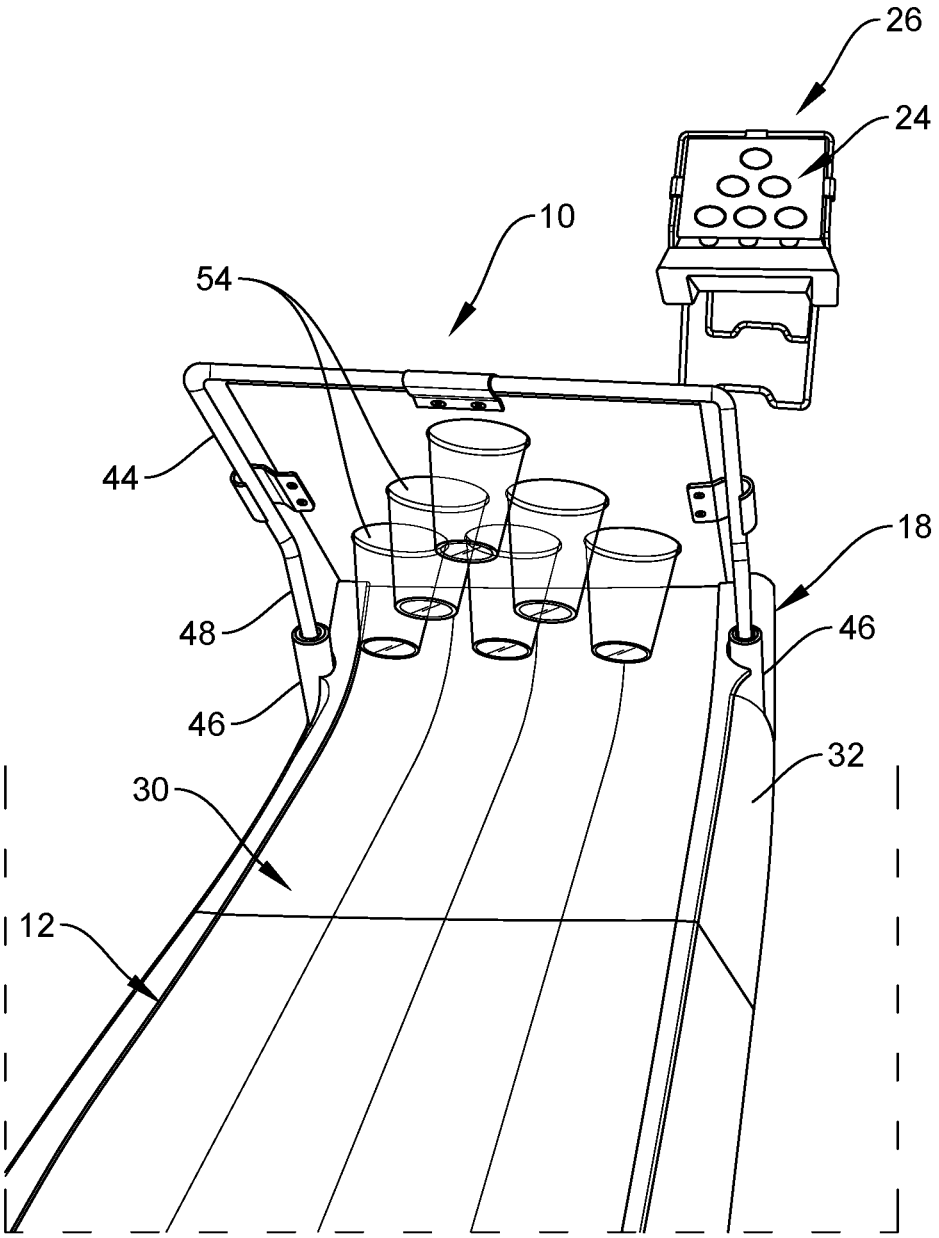
FIG. 11 is a perspective view of a first game apparatus viewed from the rear end and a spaced apart second game apparatus viewed from the front end; and, FIG. 12 is perspective view of a second target being mounted on the target frame.

Referring to the drawings more particularly by reference character, a game apparatus 10 in accordance with the present invention has an elongated runway 12 with a front end 14 and a rear end 16 with a ramp 18 position at the front end. A target 20 is supported above runway 12 before the ramp 18 at the front end with a curvature such that a projectile propelled along runway 12, passing under target 20, and sliding up ramp 18 is given an upward trajectory curving towards a target 24 of a second game apparatus 26 (FIG. 11).

Figure 8:
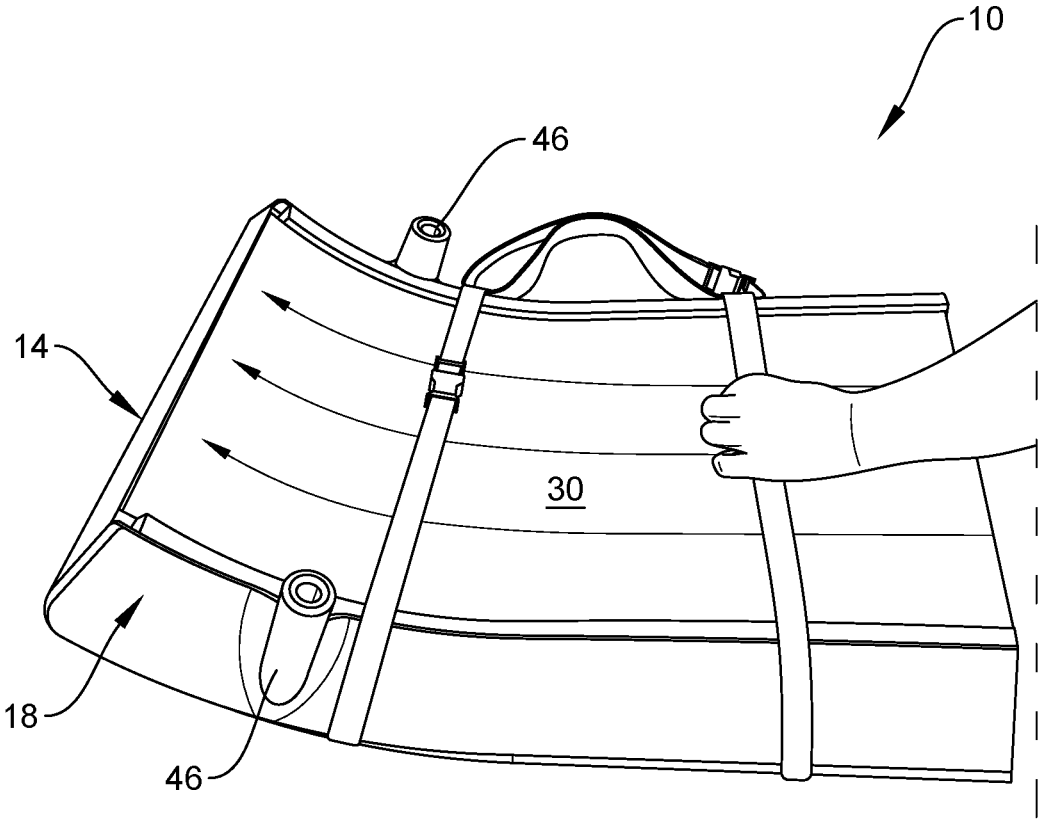
FIG. 8 is a perspective view thereof showing the apparatus folded with a carrying strap.

As best seen in FIGS. 1-5, game apparatus 10 has a bottom surface 28, top surface 30, sidewalls 32 and an S-shape in side elevation and with a flat middle section 34. Game apparatus 10 is mounted on legs 36 which may be fixed or for packability foldable with a transverse pivot joint 38 in middle section 34 such that the game apparatus may be folded in half with the bottom surface 28 of the front and rear ends 14, 16 nested together as shown in FIG. 8.

Figure 9:
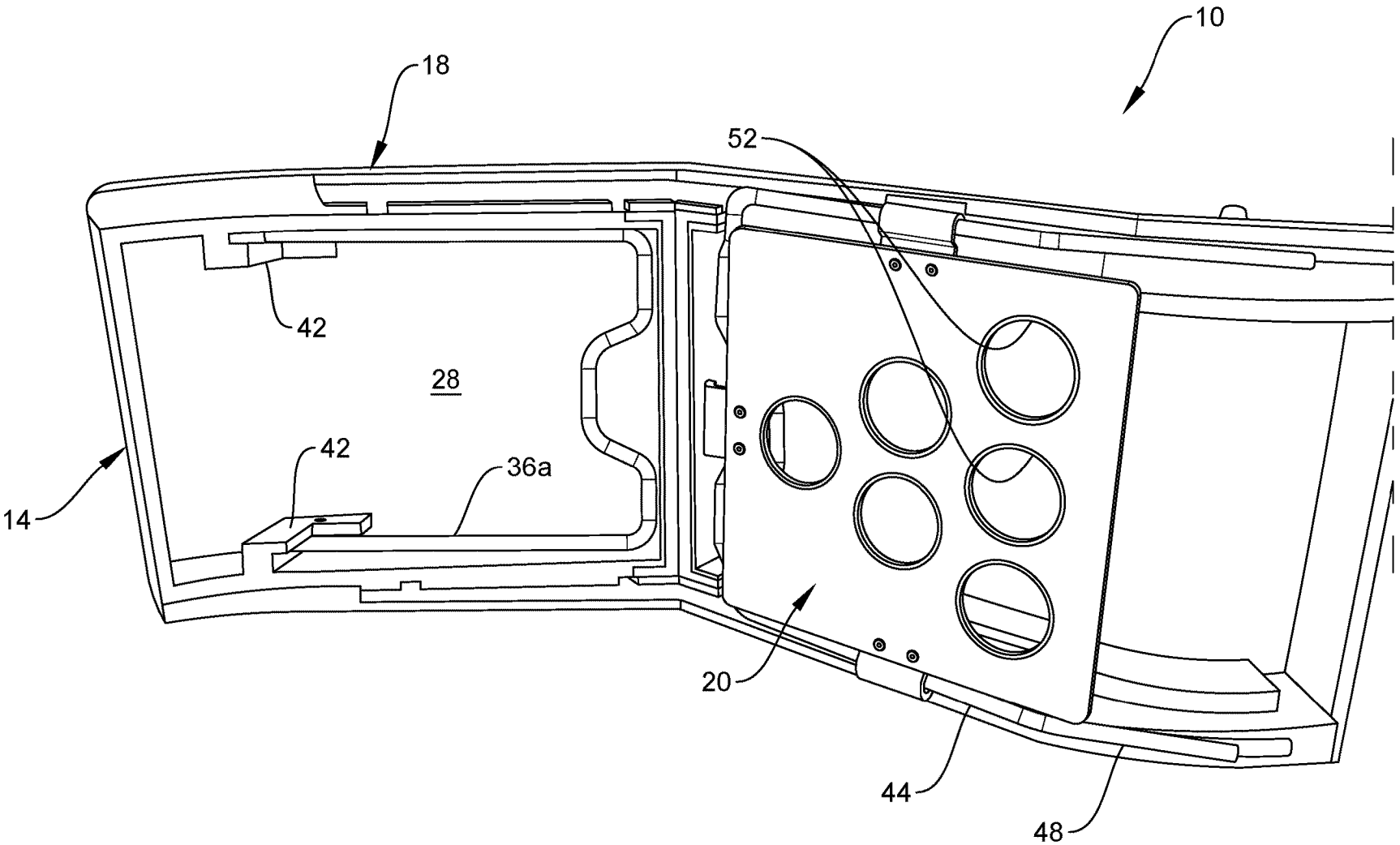
FIG. 9 is a bottom perspective showing the legs folded and a target mounted on a target frame clipped onto the bottom.
Figure 10:
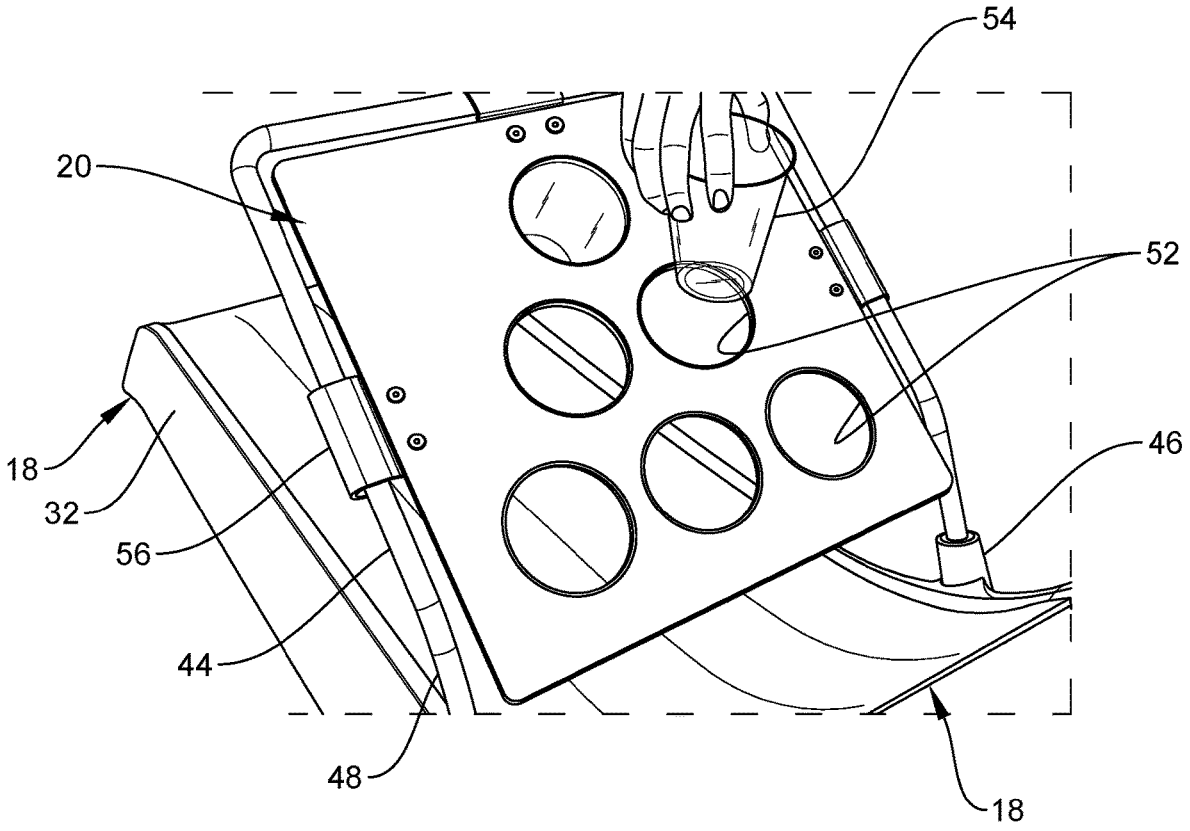
FIG. 10 is a perspective view showing a user inserting a cup into a target aperture.

In foldable form, an inwardly foldable leg **36*a* is mounted on bottom surface 28 at front end 14 and an inwardly foldable leg 36*b* is provided at rear end 16. As seen in FIG. 9, leg 36*a* and leg 36*b* are received in opposing cooperatively shaped U-shaped recesses 40 in middle section 34. In inclined position, leg 36*a* and leg 36*b* are held at a preselected angle by sloped shoulders 42 formed at an open end of each recess 40**.

Runway 12 and ramp 18 may be integral or separately formed and made of wood, metal or plastic. In like manner, legs 36 may be formed of various materials. Size also may vary depending on whether apparatus 10 is intended for outside or inside use, including table top, use. For use outside, a representative but nonlimiting example of game apparatus has a length L (See FIG. 3) of 51 inches, ramp R at height of 15 inches and target T a height of 31.75 inches. The curvature of ramp 18 may also vary but in the form illustrated is about 45 degrees. Runway 12 and ramp 18 are about 23 inches wide with a smooth surface. In the folded form as shown in FIG. 8, game apparatus 10 is 12 inches thick and 26.5 inches long.

Figure 1:
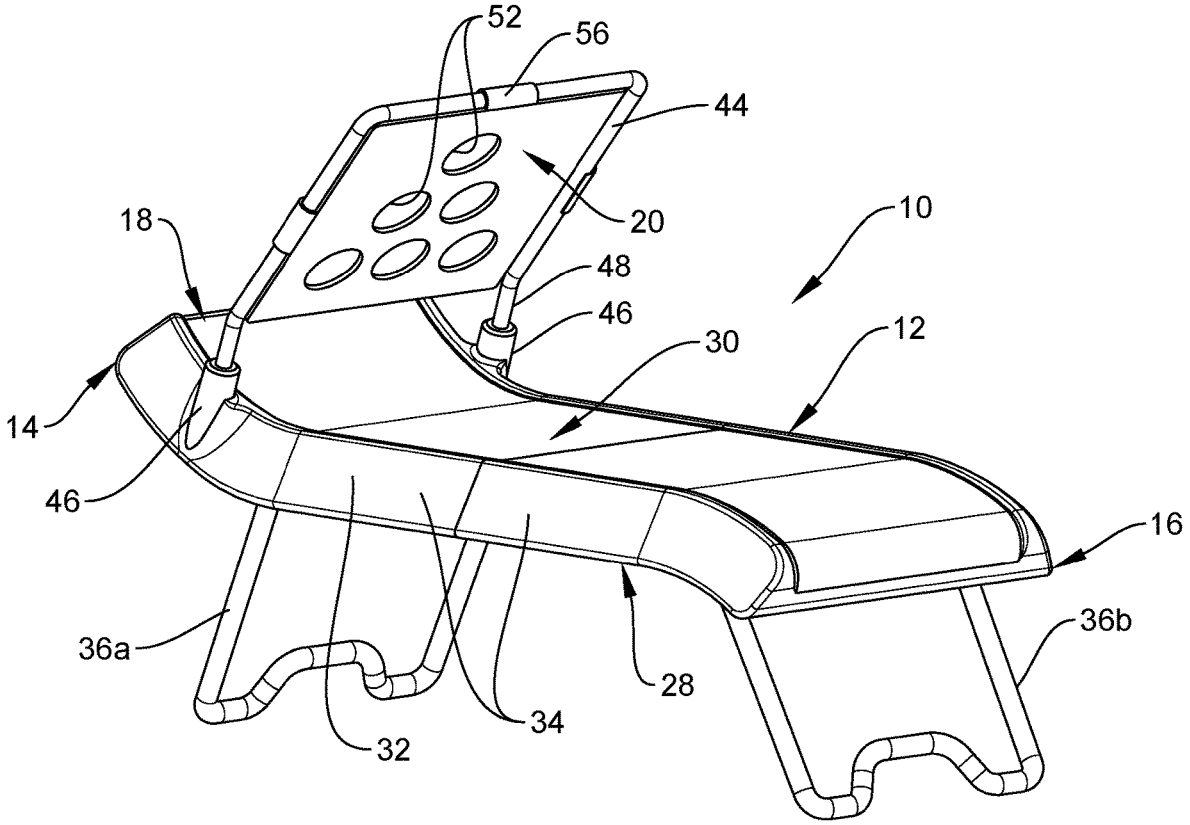
FIG. 1 is a back perspective view of a game apparatus in accordance with the present invention.
Figure 2:
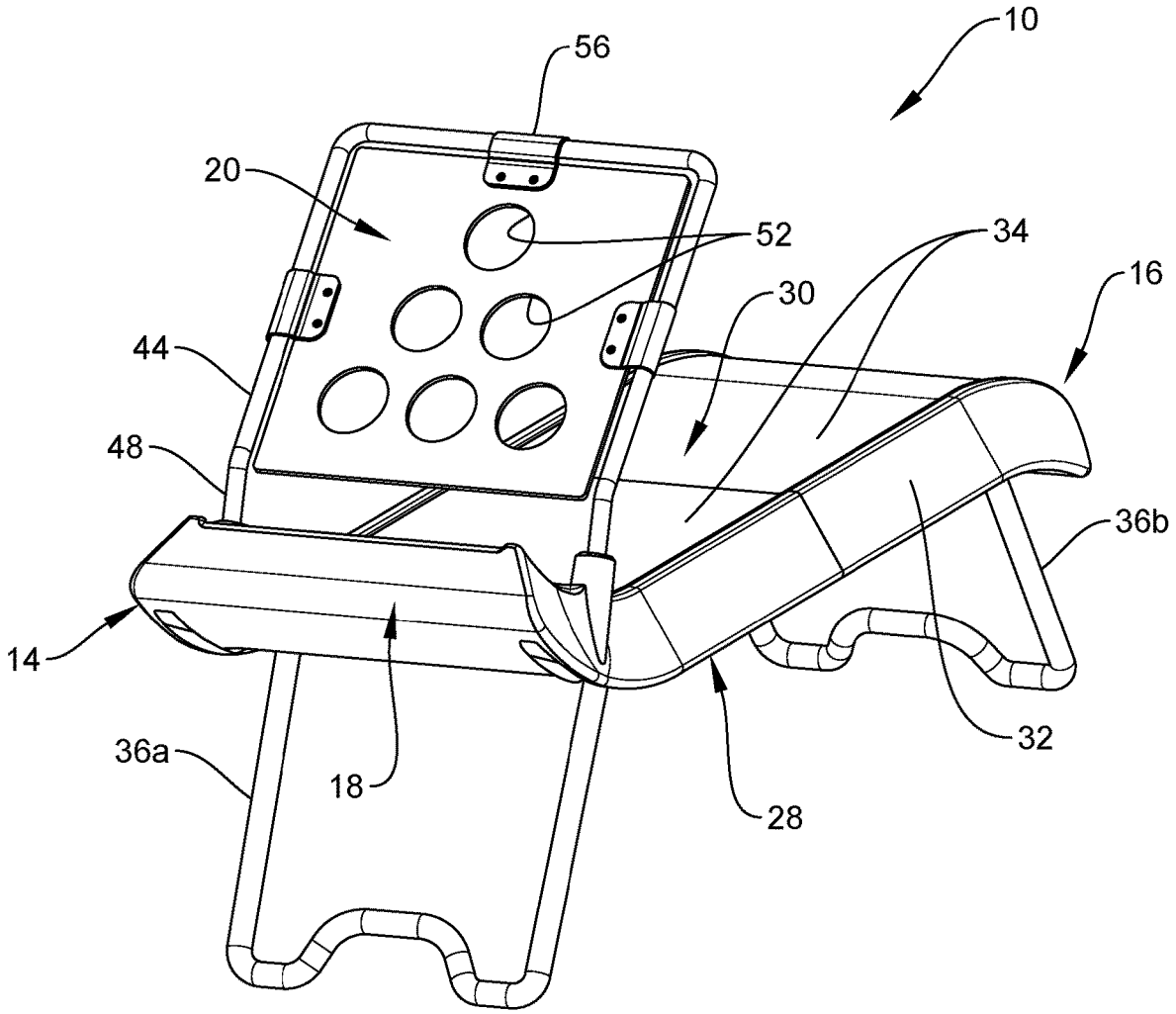
FIG. 2 is front perspective view thereof.
Figure 3:
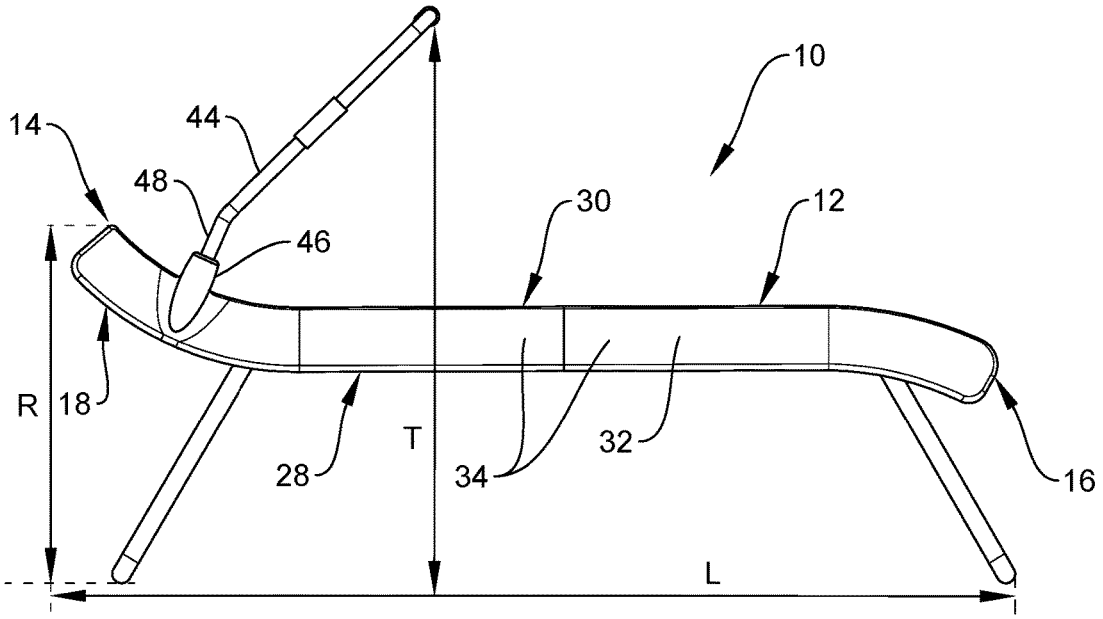
FIG. 3 is a side elevation thereof.
Figure 4:
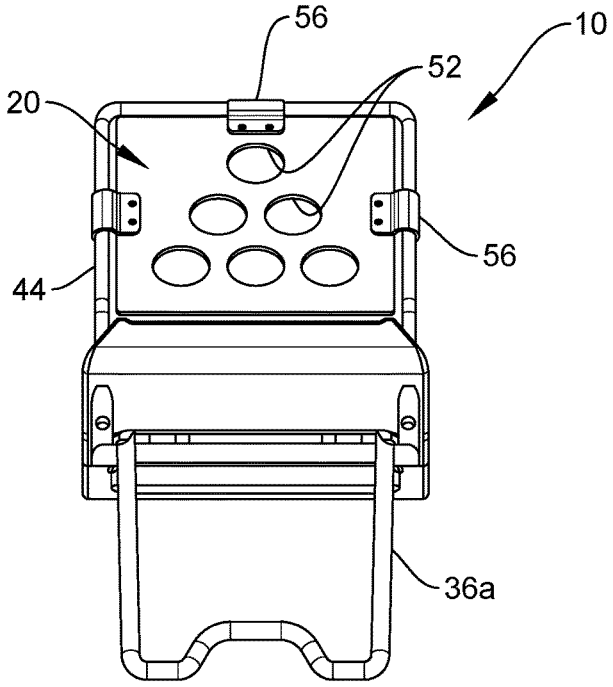
FIG. 4 is a front end elevation thereof.
Figure 5:
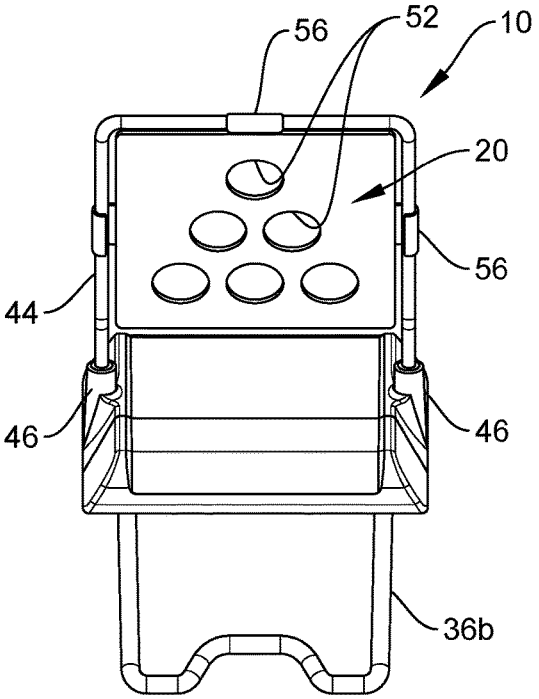
FIG. 5 is a rear end elevation thereof.
Figure 6:
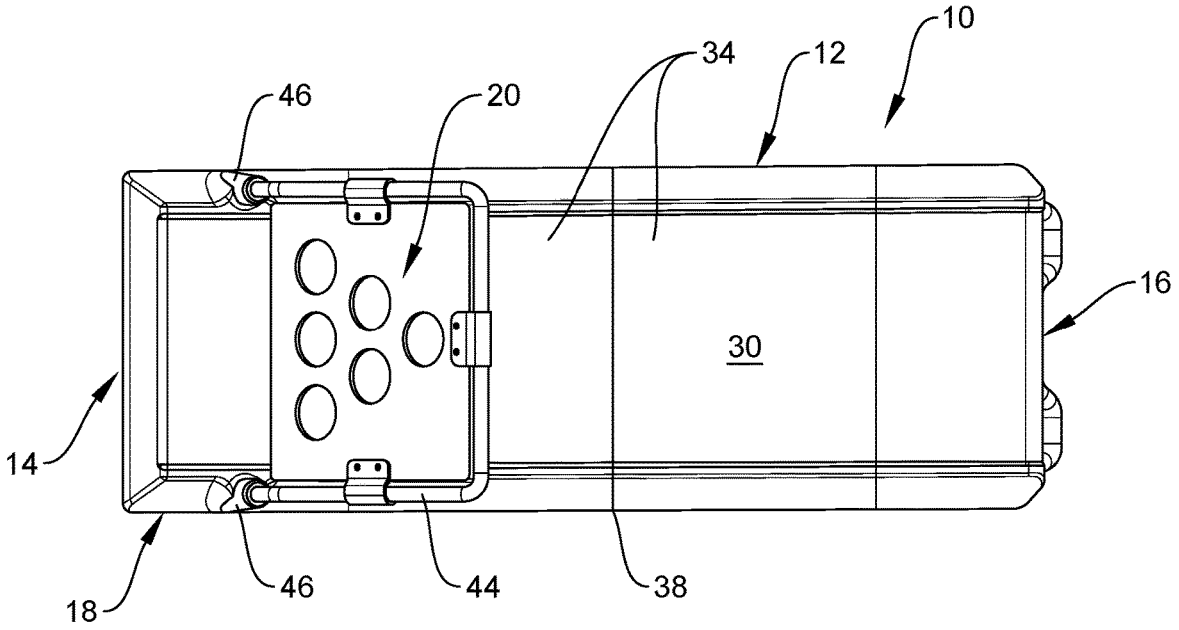
FIG. 6 is a top view thereof.
Figure 7:
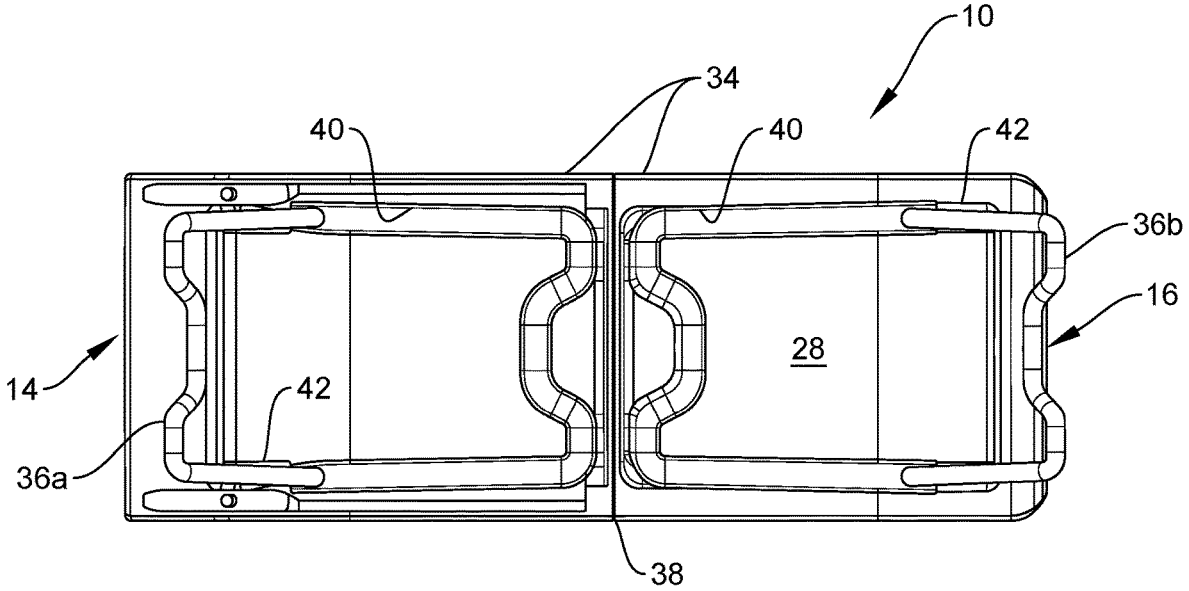
FIG. 7 is a bottom view thereof.

As shown in the drawings, target 20 is mounted on a U-shaped target frame 44 which is received in rearwardly angled receivers 46 formed on sidewalls 32 in back of ramp 18 and straddling runway 12. While frame may be fixedly mounted above runway 12 for packability it is preferred that ends 48 of target frame 44 be detachable and frictionally held on receivers 46. When detached as shown in FIG. 9, target frame 44 with target 20 may be received in a recess provided therefor in bottom surface 28 of middle section 34. As seen in FIGS. 1-3, ends 48 of target frame 44 have a dogleg out of the plane of the U-shaped frame. As shown, target 20 is angled backward. For a more challenging game, U-shaped frame 44 may be rotated 180 degree with the doglegged ends 48 inserted into receivers 46 such that target 20 is vertical.

Target 20 includes at least one receiver suitable for the projectile being used. For example, the receiver and the projectile may include male and female mating members such as Velcro. In those embodiments when the projectile is a bean bag, ball, puck or the like, target 20 includes at least one receiver. In one form shown in the drawings, target 20 has six apertures 52 arranged in a triangular array with three ranks, the lower and first of which rank has three apertures, the second rank has two apertures and the highest and last rank has one aperture.

Apertures 52 may be outfitted with a capture apparatus 54 such as a net or a cup as shown. Cup 54 may be clear plastic glass, a red Solo cup or any other kind of cup that will fit. In other embodiments, aperture (or apertures 52) may include a target that may be tipped over or knocked out as the receiver 46.

Figure 12:
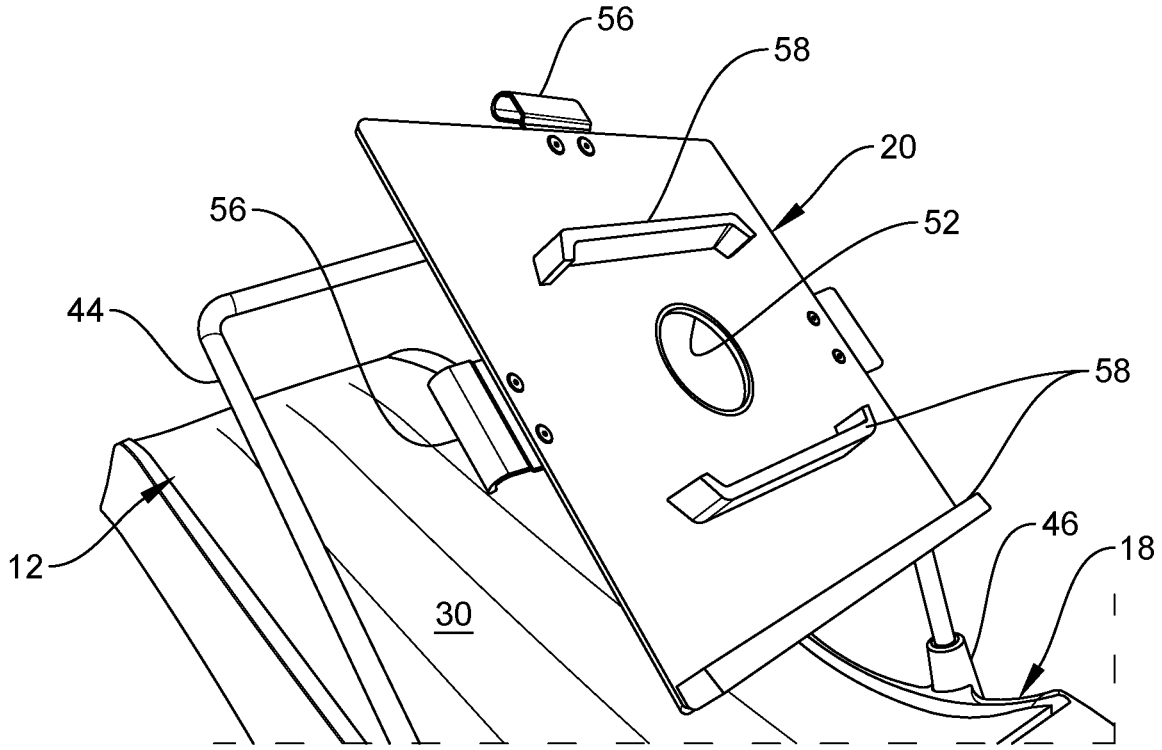

Target 20 may be mounted on target frame 44 with clips 56 or otherwise detachably mounted and other targets 24 such as shown in FIG. 12 may be used. As shown in FIG. 12, other target 24 has a single aperture 52 flanked by three shelves 58 as capture apparatus 54, a first shelf and upper one of which is positioned above aperture 52 and a second and third spaced apart shelves are positioned below aperture. Other targets 24 are possible and are contemplated such as tic tac toe, connect 4, etc.

In use as shown in FIG. 11, when a projectile is propelled down runway 12 it passes under target 20 and upon striking ramp 18 is propelled upwardly at approximately a 45 degree angle towards second game apparatus 26. At second game apparatus 26, the projectile is caught in one of capture apparatus 54 or not. A method of play is described in the following manual wherein first and second game apparatus 10 and 26 are spaced 12 feet apart but other methods of play may be devised by a user and are within the scope of the present invention. These uses include, for example removal of target 20 from game apparatus 10 and use of runway 12 and ramp 18 with game lines like shuffleboard.

Rampz Manual

Equipment:

(4x) Blue Rampz official bean bags
(4x) Red Rampz official bean bags
(2x) Rampz official game ramps
(2x) Rampz 'Knock Out' official game targets
(2x) Rampz 'Top Shot' official game targets Setup:

A regulation size Rampz court is 8 feet wide and 28 feet long with a recommended vertical clearance of 15 feet. Ramps are positioned 12 feet apart (from front edge to front edge) on a level ground.

How To Play 'Knock Out':

This game of Rampz is played as either 1v1 or 2v2 and four total bean bags are needed to play. The rules of the game are the same, regardless of whether there are two or four total players. The objective of the game is to make all six cups before your opponent(s).

A team can be made up of 1 player (1v1 gameplay), or 2 players (2v2 gameplay). Each team stands behind a Rampz game ramp and will stay there for the duration of the game. Decide which team will be shooting first. The team that goes first gets all four bags. Don't forget who went first! The team that goes second will have a 'Redemption Round' should the team that shoots first be the first team to make all six cups (same rules apply during 'Redemption Round').

One player from each team (if 2v2) shoots all four bean bags per round, and you must alternate which teammate is shooting each round. A shot is comprised of sliding one bag along the game ramp until it is launched off the ramp towards the opposing game target. A shot is illegal if the bean bag fails to contact the game ramp. Players must also keep at least one foot behind the start of the game ramp, but they can step to the side with their other foot. After the fourth shot, all cups that were successfully made should be removed from the target. A successful hit is when a bag is completely inside the cup. A shooter does not have to call his shot. It is now time for the other team to shoot.

Continue this alternating motion of play until the last cup is removed. As soon as that happens, determine whether the team that sunk all six targets was the team that shot first or second. If they shot second, the game is over, and they claim victory. However, if they shot first, the other team now enters 'Redemption Round' where they have a chance to tie up the game. If they are unable to make their remaining cups by the end of the turn, the game is officially over. If they are successful in making their remaining cups, get pumped for some Overtime!

For Overtime gameplay, replace 3 of the cups at the top 3 positions on each game target. Continue gameplay until all 3 cups are made for a team, but still grant the team that shoots second another 'Redemption Round' if applicable. Should they tie it up during an Overtime 'Redemption Round', restart Overtime gameplay and repeat as necessary.

We do recommend playing Rampz 'Knock Out' as a series of 3 games in which teams switch sides after each game, but players' choice! If you want to step up the difficulty, make your opponents call their shots correctly in order for cups to be removed.

How To Play 'Top Shot':

This game of Rampz is played as either 1v1 or 2v2 and 8 total bean bags (4 bags of same color per team) are needed to play. The rules of the game are the same regardless of whether there are two players or four. The objective of the game is to be the first team to score at least 11 points (or 21 if you want a longer game).

A team can be made up of 1 player (1v1 gameplay), or 2 players (2v2 gameplay). For 1v1, each team will play from the same game ramp during each round, with each team having four bean bags. For 2v2, each team will have one player behind each game ramp and they will stay there for the duration of the game.

The team with blue bags shoots first, called 'Team 1' for future reference, or just decide who goes first. 'Team 1' will shoot all 4 bags before 'Team 2' shoots their 4 bags. A shot is comprised of sliding one bag along the ramp until it is launched off the ramp towards the opposing game target. A shot is illegal if the bean bag fails to contact the game ramp. Players must also keep at least one foot behind the start of the game ramp, but they can step to the side with their other foot. Once all eight bags have been launched, the round is over and it is time to score points for that round (see Scoring below). The team who scored in that round, if playing 'cancel' scoring, or the team who scored the most points, if playing cumulative scoring, has won the round and will shoot first in the next round. Scores for each team are accumulated per round until one team hits the agreed-upon winning total, 21 or 11. In a game of 21, a winner can also be determined if one team is winning 11-0. This would be a shutout win (i.e., a mercy rule).

'Top Shot' Scoring

A score happens when a bag is either partially or fully inside the hole/cup or is resting on any one of the three shelves. Scoring for each area is defined as follows:

- ♦ Hole/Cup a.k.a. 'Zing-er'=3 points each
  - ○ A bag fully inside the hole/cup
- ♦ Small Shelves a.k.a. 'Two-fer'=2 points each
  - ○ A bag resting on one of the two small shelves, or
  - ○ A bag partially inside the hole/cup
- ♦ Bottom Shelf a.k.a. 'One-er'=1 point each ○ A bag resting on the big bottom shelf Calculating Scores

- ♦ 'Cancel' scoring is the preferred scoring method for skilled players and competitive gameplay. If teams agree to not play with 'cancel' scoring, they can simply add up all points for each team each round and play to 21.

In view of the above, it will be seen that the object of the invention is achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A first game apparatus comprising an elongated runway having a front end and a rear end with a ramp positioned at the front end, a target supported above the runway in back of the ramp, said target mounted on a frame having ends received in a rearwardly angled receiver straddling the runway; said ramp having a curvature of about 45 degrees to the runway such that a projectile propelled along the runway, passing under the target, and sliding up the ramp is given an upward trajectory curving forward of the front end of the first game apparatus towards a target of a second game apparatus.

2. The first game apparatus of claim 1 wherein the runway and ramp of the apparatus has a bottom surface and a top surface and a flattened S-shape in a side elevation.

3. The first game apparatus of claim 1 wherein the runway of the game apparatus has a transverse pivot joint for folding the game apparatus.

4. The first game apparatus of claim 1 wherein the game apparatus has a first inwardly foldable leg mounted on the bottom surface at the front end and a second foldable leg is mounted on the bottom surface at the rear end.

5. A first game apparatus comprising an elongated runway having a front end and a rear end with a ramp positioned at the front end, a target supported above the runway in back of the ramp, said ramp having a curvature of about 45 degrees to the runway such that a projectile propelled along the runway, passing under the target, and sliding up the ramp is given an upward trajectory curving forward of the front end of the first game apparatus towards a target of a second game apparatus, said runway and ramp of the game apparatus having a bottom surface, a top surface, sidewalls and an S-shape in a side elevation with a flat middle section and a first inwardly foldable U-shaped leg mounted on the bottom surface in the middle section at the front end and a second inwardly foldable U-shaped leg mounted on the bottom surface in the middle section at the rear end, said first and second inwardly foldable U-shaped legs received in opposing cooperatively shaped U-shaped recesses in the middle section of the bottom surface, each of first and second inwardly foldable U-shaped legs held in a preselected inclined position by sloped shoulders formed at an open end of each of said cooperatively shaped U-shaped recesses.

6. The first game apparatus of claim 5 wherein the target of the game apparatus is mounted on a U-shaped frame having ends received in a rearwardly angled receiver positioned on the sidewalls and straddling the runway.

7. The first game apparatus of claim 6 wherein a dogleg is formed in the ends and out of the plane of the U-shaped frame of the game apparatus.

8. A first game apparatus comprising an elongated runway having a front end and a rear end with a ramp positioned at the front end, a target supported above the runway in back of the ramp, said ramp having a curvature such that a projectile propelled along the runway, passing under the target, and sliding up the ramp is given an upward trajectory curving towards a target of a second game apparatus, said runway and ramp of each game apparatus having a bottom surface, a top surface and sidewalls and an S-shape in a side elevation with a flat middle section and a first inwardly foldable U-shaped leg mounted on the bottom surface in the middle section at the front end and a second inwardly foldable U-shaped leg mounted on the bottom surface in the middle section at the rear end, said first and second inwardly foldable U-shaped legs received in opposing cooperatively shaped U-shaped recesses in the middle section of the bottom surface, each of the first and second inwardly foldable U-shaped legs held in a preselected inclined position by sloped shoulders formed at an open end of each of said cooperatively shaped U-shaped recesses, said target of each game apparatus mounted on a U-shaped frame having ends received in a rearwardly angled receiver positioned on the sidewalls and straddling the runway, said U-shaped frame having a dogleg in the ends and out of the plane of U-shaped frame.

9. The first game apparatus of claim 8 wherein the target of the game apparatus has at least one aperture sized to receive a projectile.

10. The first game apparatus of claim 9 wherein the projectile of the game apparatus is a bean bag and the aperture is fitted with a cup to hold the bean bag.

11. The first game apparatus of claim 8 wherein the target of the game apparatus has six apertures sized to receive a projectile, said apertures arranged in a triangular array with three ranks, the lower and first of which has three apertures, the second rank has two apertures and the highest and last rank having one aperture.

12. The first game apparatus of claim 11 wherein the apertures of the game apparatus are sized to receive a bean bag.

13. The first game apparatus of claim 12 wherein each aperture of the game apparatus includes a capture apparatus.

14. The first game apparatus of claim 13 wherein the capture apparatus is a cup or net.

15. The first game apparatus of claim 8 wherein the target of the game apparatus has at least one aperture sized to receive a projectile flanked by three shelves, a first and upper one positioned above the aperture and a second and third spaced apart shelves positioned below the aperture.

* * * * *